US010131846B2

(12) United States Patent
Chung

(10) Patent No.: US 10,131,846 B2
(45) Date of Patent: Nov. 20, 2018

(54) APPARATUS AND METHOD FOR SUPPLYING CONTINUOUS HEAT/PRESSURE TO CONTINUOUSLY FEED AND DISCHARGE HEATED/PRESSURIZED OIL SHALE SLUDGE IN KEROGEN EXTRACTION REACTOR

(71) Applicant: CRI CO., LTD., Daejeon (KR)

(72) Inventor: Soo Hyun Chung, Daejeon (KR)

(73) Assignee: CRI CO., LTD, Daejeon (KR)

( * ) Notice: Subject to any disclaimer, the term of this patent is extended or adjusted under 35 U.S.C. 154(b) by 339 days.

(21) Appl. No.: 14/894,577

(22) PCT Filed: Dec. 4, 2013

(86) PCT No.: PCT/KR2013/011164

§ 371 (c)(1),
(2) Date: Nov. 30, 2015

(87) PCT Pub. No.: WO2014/200167

PCT Pub. Date: Dec. 18, 2014

(65) Prior Publication Data

US 2016/0122656 A1 May 5, 2016

(30) Foreign Application Priority Data

Jun. 12, 2013 (KR) ..... 10-2013-0066931
Jun. 28, 2013 (KR) ..... 10-2013-0075029

(51) Int. Cl.
*C10G 1/04* (2006.01)
*C10G 1/02* (2006.01)

(52) U.S. Cl.
CPC ..... *C10G 1/045* (2013.01); *C10G 1/02* (2013.01); *C10G 1/04* (2013.01)

(58) Field of Classification Search
CPC ..... C10G 1/045; C10G 1/04; C10G 1/02
See application file for complete search history.

(56) References Cited

U.S. PATENT DOCUMENTS 4,060,479 A 11/1977 Barcellos
4,576,708 A 3/1986 Oko et al.
(Continued)

OTHER PUBLICATIONS

International Search Report for PCT/KR2013/011164 dated Mar. 7, 2014.

*Primary Examiner* — Randy Boyer
*Assistant Examiner* — Juan C Valencia
(74) *Attorney, Agent, or Firm* — STIP Law Group, LLC

(57) ABSTRACT

The present invention relates to an improvement over the invention previously submitted by the inventor relating to an apparatus for recovering heavy oil from oil shale and a method for recovery using same, the present invention relating to an apparatus for supplying continuous heat/pressure to continuously supply and discharge oil shale sludge, in which a plurality of unit extraction apparatuses, comprising a kerogen extraction apparatus and an intermediate storage tank, are installed to implement a continuous operation, which is an improvement over a semi-continuous operation of alternately operating the kerogen extraction apparatus and the intermediate storage tank. According to the present invention, the kerogen extraction apparatus can be continuously operated as sludge in a pressurized state can be continuously supplied by disposing a pressurized supply pump for sludge in between the continuous mixing apparatus for oil shale/extractant and the kerogen extraction apparatus, and a pressure-controlling discharging valve on the exit side thereof, and as the oil shale and extractant/light oil added into the continuous oil shale/extractant mixing apparatus are maintained in the preliminary previously-heated state, the energy load of the kerogen extraction apparatus,
(Continued)

for heating the thermal medium of the oil shale/extractant continuous mixing apparatus, can be reduced as the load can be shared with the continuous mixing apparatus, and thus has the benefit of reducing expenses due to a reduction in the size of the reactor and the ease of scaling-up.

5 Claims, 1 Drawing Sheet

(56) References Cited

U.S. PATENT DOCUMENTS

| | | | | |
|---|---|---|---|---|
| 4,587,006 | A | 5/1986 | Minden | |
| 4,983,278 | A * | 1/1991 | Cha | C10B 47/44<br>208/407 |
| 5,000,389 | A | 3/1991 | So et al. | |
| 2003/0098262 | A1 | 5/2003 | Rendall | |
| 2006/0096163 | A1 * | 5/2006 | Dickinson | C10G 1/00<br>44/552 |
| 2007/0215071 | A1 * | 9/2007 | Dearth | F02B 43/10<br>123/3 |

* cited by examiner

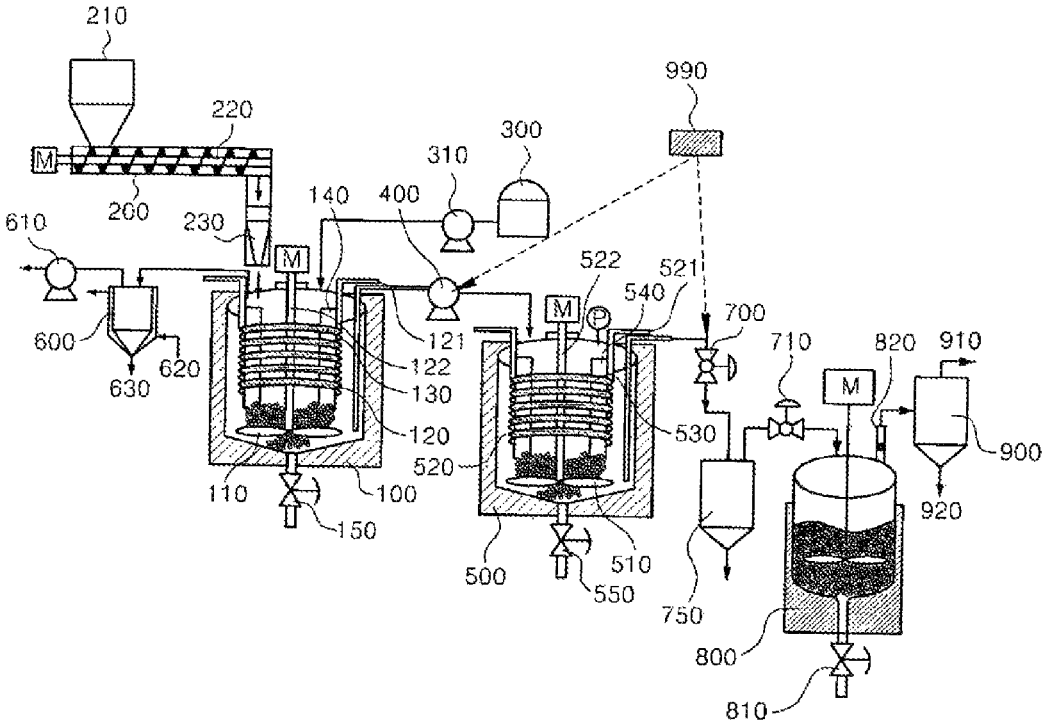
210
220
M
200
230
610
600
620
630
140
400
310
300
990
M
121
122
130
120
110
100
150
522
521
540
M
P
700
530
520
500
510
550
710
820
910
M
900
920
750
800
810

APPARATUS AND METHOD FOR SUPPLYING CONTINUOUS HEAT/PRESSURE TO CONTINUOUSLY FEED AND DISCHARGE HEATED/PRESSURIZED OIL SHALE SLUDGE IN KEROGEN EXTRACTION REACTOR

CROSS-REFERENCE TO RELATED APPLICATIONS

This application is the U.S. National Phase under 35 U.S.C. § 371 of International Application No. PCT/KR2013/011164 filed on Dec. 4, 2013, which in turn claims the benefit of Korean Application No. 10-2013-0066931, filed on Jun. 12, 2013 and Korean Application No. 10-2013-0075029 filed on Jun. 28, 2013, the disclosures of which are incorporated by reference into the present application.

TECHNICAL FIELD

The present invention relates to an apparatus and method for pressurized heating, and continuously supplying and discharging oil shale sludge used in a recovery system and method for effectively recovering kerogen contained in oil shale, as a form of heavy oil, and to an apparatus and method for heating, pressurizing, and continuously supplying and discharging oil shale sludge, wherein the oil shale sludge is made by mixing oil shale with extractant/light oil and continuously supplied from an oil shale/extractant continuous mixing part to a kerogen extraction part, while being continuously discharged from the kerogen extraction part.

More particularly, the present invention relates to an apparatus and method for heating, pressurizing, and continuously supplying and discharging oil shale sludge, and the apparatus includes: an oil shale supplying part for supplying oil shale stored in an oil shale storage tank, from which water is removed, to an oil shale/extractant continuous mixing part, through a supplying pipe connector; an extractant/light oil supplying pump for supplying the extractant or light oil stored in an extractant storage tank to the oil shale/extractant continuous mixing part; a sludge pressurizing and supplying pump for conveying the oil shale sludge made by agitating and mixing the oil shale and the extractant/light oil in the oil shale/extractant continuous mixing part to a kerogen extraction part; and an organic oil vapor recovery part for condensing and recovering the organic oil vapor generated during the heating of the oil shale/extractant continuous mixing part.

According to the present invention, the apparatus and method for pressurized heating and continuously supplying the oil shale sludge are configured wherein the oil shale sludge made by mixing the oil shale and the extractant/light oil is pre-heated at a lower temperature than a kerogen extraction temperature and supplied at the pressurized state to the kerogen extraction part, thus advantageously allowing the kerogen extraction part to be continuously operated. Further, the oil shale and the extractant/light oil being supplied to the oil shale/extractant continuous mixing part are pre-heated before supplied, thus reducing the energy load of the kerogen extraction part caused by the heating of the heat medium of the oil shale/extractant continuous mixing part and decreasing the reaction size (that is, residence time) of the kerogen extraction part. Furthermore, the present invention relates to the apparatus and method for continuously discharging the oil shale sludge, wherein through the continuous supplying, the oil shale sludge supplied to the kerogen extraction part is continuously discharged after staying for a predetermined period of time therein.

In addition, the organic oil vapor generated during the heating of the oil shale/extractant continuous mixing part is condensed and recovered, thus preventing the organic oil vapor generated from the oil shale/extractant continuous mixing part from being discharged to the air.

BACKGROUND ART

The shale oil obtained from oil shale has the similar properties to crude oil, and accordingly, the shale oil is highlighted as next generation petroleum resources. A method for recovering crude oil components from the oil shale is classified into a method for retorting the oil shale through mining and a method for heating oil shale buried under the ground. The retorting method is also classified into a method for charging the oil shale in a reactor to heat the oil shale from the outside, a method for conducting pyrolysis of oil shale through the contact of combustion gas in a reactor, and a method for conducting pyrolysis of oil shale through solid-solid phase contact between a heated solid medium and heated oil shale.

The pyrolysis method adopts heating of non-conductive oil shale, and as a result, a large portion of kerogen components are converted into noncondensable gas, not into shale oil. Therefore, if the yield of crude oil components is calculated in terms of the volatile matters contained in the oil shale, it is just under 40%, which is very low (See U.S. Pat. No. 4,576,708, U.S. Pat. No. 4,963,250, U.S. Pat. No. 5,000,349, and U.S. Pat. No. 7,500,517).

According to the conventional methods for recovering the crude oil components through the direct or indirect heating of the oil shale, the energy load per unit of crude oil production is large, and pollutants and carbon dioxide are emitted from the combustion process of the organic components of the residual matters. Therefore, there is a definite need for the development of an eco-friendly crude oil recovery apparatus and method capable of improving a quantity of crude oil produced.

So as to remove the above-mentioned problems, accordingly, a heavy oil recovery apparatus and method is filed by the same applicant as the invention, wherein kerogen extraction is performed in the form of heavy oil, not in the form of polymer, at a lower temperature in the range of 200 to 400° C. than the pyrolysis temperature of the oil shale of 500° C., and most of volatile matters in the oil shale are converted into crude oil components, thus drastically increasing the yield of the crude oil components and decreasing the energy load per unit of crude oil production (See Korean Patent Laid-open Publication Nos. 2013-0025437 and 2013-0066913).

DISCLOSURE

Technical Problem

Accordingly, the present invention has been made in view of the above-mentioned problems occurring in the prior art, and it is an object of the present invention to provide an improvement of a recovery system and method for recovering heavy oil from oil shale, which is filed by the same applicant as the invention, wherein an apparatus and method for pressurized heating, and continuously supplying and discharging oil shale sludge is configured to improve a semi-continuous operation in which a plurality of unit extractors each has a kerogen extraction part and an intermediate storage tank and the kerogen extraction part and the intermediate storage tank are alternately operated, thus achieving a continuous operation.

According to the conventional recovery system and method as filed by the same applicant as the invention, a pressure damper is used in the step of introducing the oil shale sludge mixture agitated and mixed in an oil shale/extractant continuous mixing part into a kerogen extraction part so as to pressurize the oil shale sludge, so that batch type extraction is conducted, and so as to solve the problem, a plurality of unit extractors is disposed to propose a semi-continuous operation. However, there is a need to improve the productivity and reactor size in the recovery system and method.

According to the present invention, a sludge pressurizing and supplying pump is disposed between the oil shale/extractant continuous mixing part and the kerogen extraction part, and a pressure control discharging valve is disposed at the outlet of the kerogen extraction part, so that the oil shale sludge can be continuously supplied at the state of being pressurized to the kerogen extraction part and then discharged from the kerogen extraction part, thus performing the continuous operation of the kerogen extraction part.

Further, the oil shale and the extractant/light oil are pre-heated before introduced into the oil shale/extractant continuous mixing part, so that the energy load of the kerogen extraction part caused by the heating of the heat medium of the oil shale/extractant continuous mixing part is divided together with the oil shale/extractant continuous mixing part and thus reduced, thus decreasing the reactor size (that is, residence time) and solving the economical problems through the scale-up in commercial process.

Technical Solution

To accomplish the above-mentioned objects, according to a first aspect of the present invention, there is provided an apparatus for pressurized heating, and continuously supplying and discharging oil shale sludge to and from a kerogen extraction part, the apparatus including: an oil shale supplying part for supplying oil shale stored in an oil shale storage tank, from which water is removed, to an oil shale/extractant continuous mixing part, through a supplying pipe connector; an extractant/light oil supplying pump for supplying the extractant or light oil stored in an extractant storage tank to the oil shale/extractant continuous mixing part; a sludge pressurizing and supplying pump for conveying the oil shale sludge made by agitating and mixing the oil shale and the extractant/light oil in the oil shale/extractant continuous mixing part to the kerogen extraction part; an organic oil vapor recovery part for condensing and recovering the organic oil vapor generated during the heating of the oil shale/extractant continuous mixing part; and a first pressure control discharging valve for discharging the oil shale extraction residual matters remaining after the extraction of the oil shale sludge in the kerogen extraction part.

To accomplish the above-mentioned objects, according to a second aspect of the present invention, there is provided a method for pressurized heating, and continuously supplying and discharging oil shale sludge to and from a kerogen extraction part, the method including the steps of: supplying oil shale stored in an oil shale storage tank, from which water is removed, from an oil shale supplying part to an oil shale/extractant continuous mixing part, through a supplying pipe connector; supplying the extractant or light oil stored in an extractant storage tank to the oil shale/extractant continuous mixing part through an extractant/light oil supplying pump; conveying the oil shale sludge made by agitating and mixing the oil shale and the extractant/light oil in the oil shale/extractant continuous mixing part to a kerogen extraction part through a sludge pressurizing and supplying pump; condensing and recovering the organic oil vapor generated during the heating of the oil shale/extractant continuous mixing part through an organic oil vapor recovery part; and discharging the oil shale extraction residual matters remaining after the extraction of the oil shale sludge in the kerogen extraction part through a first pressure control discharging valve.

According to the present invention, desirably, the oil shale/extractant continuous mixing part and the kerogen extraction part have agitators disposed on the interiors thereof to pass heat media therethrough. Further, the oil shale/extractant continuous mixing part and the kerogen extraction part have heat medium heating coils disposed on the interiors thereof. Furthermore, the oil shale/extractant continuous mixing part and the kerogen extraction part have support plates mounted on the interiors thereof so as to support the heating coils, the supports plates serving as baffles adapted to increase mixing and heating effects.

According to the present invention, desirably, the oil shale stored in the oil shale storage tank, from which water is removed, and the extractant or light oil supplied to the oil shale/extractant continuous mixing part through the extractant/light oil supplying pump are pre-heated at a lower temperature of 200 to 300° C. than the operating operation of the oil shale/extractant continuous mixing part.

According to the present invention, desirably, the oil shale sludge mixture conveyed from the oil shale/extractant continuous mixing part operated at an atmospheric pressure to the kerogen extraction part through the sludge pressurizing and supplying pump is pressurized at a higher pressure than an operating pressure of the kerogen extraction part.

According to the present invention, desirably, the first pressure control discharging valve for discharging the oil shale extraction residual matters remaining after the extraction of the oil shale sludge in the kerogen extraction part is connected sequentially to a buffering tank, a second pressure control discharging valve and an intermediate storage tank, so that the pressure control in the kerogen extraction part is easily performed.

According to the present invention, desirably, the internal pressure of the kerogen extraction part is constantly controlled through the first pressure control discharging valve, thus continuously discharging the oil shale sludge at the constant pressure.

Advantageous Effects

According to the present invention, there is provided the apparatus and method for pressurized heating and continuously supplying the oil shale sludge, wherein the oil shale sludge made by mixing the oil shale and the extractant/light oil is pre-heated at a lower temperature than a kerogen extraction temperature and continuously supplied at the pressurized state to the kerogen extraction part, thus advantageously allowing the kerogen extraction part to be continuously operated.

Further, the oil shale and the extractant/light oil are pre-heated before introduced into the oil shale/extractant continuous mixing part, so that the energy load of the kerogen extraction part caused by the heating of the heat medium of the oil shale/extractant continuous mixing part is divided together with the oil shale/extractant continuous mixing part and thus reduced, thus decreasing the reactor size (that is, residence time) and solving the economical problems through the scale-up in commercial process.

At the same time, the discharge pressure of the sludge pressurizing and supplying pump into the kerogen extraction part is somewhat higher than the internal pressure of the kerogen extraction part, and the pressure control discharging valve is disposed at the outlet of the kerogen extraction part, thus conducting the pressurized heating, and the continuous supplying and discharging.

The supply of the oil shale sludge from the oil shale/extractant continuous mixing part to the kerogen extraction part through the sludge pressurizing and supplying pump is cooperatively operated with the first and second pressure control discharging valves disposed on the rear end of the kerogen extraction part, thus maintaining the balance between the continuous supplying and the continuous discharging. So as to achieve the continuous supplying and the continuous discharging at a given pressure, further, the degree of opening and closing of the first pressure control discharging valve and the quantity of supply of the sludge pressurizing and supplying pump are automatically controlled by means of a proportional controller. Accordingly, the kerogen extraction part is maintained at the given pressure, and the residence time, that is, reaction time in the kerogen extraction part is controllable.

Further, the organic oil vapor recovery part is additionally provided to condense and recover the organic oil vapor generated during the heating of the oil shale/extractant continuous mixing part, thus preventing the organic oil vapor generated from the oil shale/extractant continuous mixing part from being discharged to the air.

DESCRIPTION OF DRAWINGS

FIG. 1 is a schematic view showing a configuration of an apparatus for pressurized heating, and continuously supplying and discharging oil shale sludge according to the present invention.

BEST MODE FOR INVENTION

Hereinafter, an explanation on an apparatus and method for pressurized heating, and continuously supplying and discharging oil shale sludge according to the present invention will be in detail described with reference to the attached drawing.

FIG. 1 is a schematic view showing a configuration of an apparatus for pressurized heating, and continuously supplying and discharging oil shale sludge according to the present invention. According to the present invention, the apparatus includes an oil shale/extractant continuous mixing part 100, an oil shale supplying part 200, an extractant storage tank 300, a sludge pressuring and supplying pump 400, a kerogen extraction part 500, and organic oil vapor recovery part 600. Under the connection structure of the above-mentioned parts of the apparatus, the kerogen extraction part 500 is operated continuously.

The oil shale/extractant continuous mixing part 100 and the kerogen extraction part 500 have the same configurations as in a heavy oil recovery device and method (Korean Patent Application Laid-open No. 2013-0025437) filed by the same applicant as the invention, and they have heat medium heating coils 130 and 530 and heat medium introduction portions 121 and 521 disposed on the interiors of bodies and the outer walls thereof, through which heat media 120 and 520 are passed. Further, the heat media 120 and 520 are supplied and circulated to agitating and rotating shafts 122 and 522.

According to the present invention, especially, the oil shale/extractant continuous mixing part 100 and the kerogen extraction part 500 have the heating coils mounted on the outer walls thereof in the form of a jacket so as to allow the heat media to pass through the outer walls and at the same time to allow the heat media to pass through the interiors thereof, and further have support plates connected to the heating coils by means of welding to support the heating coils. In addition, the supports plates serve as baffles 140 and 540 that form vortexes by agitation to optimize the heat discharged from the heating coils.

The oil shale is introduced into an oil shale storage tank 210 in the state of being pre-heated to a temperature in the range of 200 to 300° C., and after that, the oil shale is fed into the oil shale/extractant continuous mixing part 100 through the oil shale supplying part 200 on which a screw 220 is mounted and then through a supplying pipe connector 230. Next, the extractant or light oil stored in the extractant storage tank 300 is supplied to the oil shale/extractant continuous mixing part 100 through an extractant/light oil supplying pump 310 in the state of being pre-heated to a temperature in the range of 200 to 300° C. At this time, the quantity of extractant/light oil fed is desirably about two to three times the solid oil shale being fed.

The oil shale/extractant continuous mixing part 100 is operated at an atmospheric pressure to uniformly mix the oil shale and the extractant/light oil fed thereto and further to conduct the pre-heating for them, thus reducing the heating load of the kerogen extraction part 500 to an extraction temperature (200 to 400° C.).

The oil shale sludge made by mixing the oil shale and the extractant/light oil in the oil shale/extractant continuous mixing part 100 is conveyed to the kerogen extraction part 500 through a sludge pressurizing and supplying pump 400. Through the sludge pressurizing and supplying pump 400, at this time, the supplying pressure of the oil shale sludge is somewhat higher than the internal pressure of the kerogen extraction part 500.

Further, the kerogen extraction part 500 has a pressure control discharging valve disposed on a sludge discharge portion thereof, thus being maintained at a high temperature and high pressure state. Accordingly, the pressure damper used in the prior art (Korean Patent Application Laid-open No. 2013-0025437) filed by the same applicant as the invention is not adopted in the present invention, and according to the present invention, further, a semi-continuous extraction process in which a plurality of unit extractors is alternately operated is changed into a continuous extraction process.

According to the present invention, the apparatus for pressurized heating, and continuously supplying and discharging the oil shale sludge further includes the organic oil vapor recovery part 600. The organic oil vapor generated during the heating of the oil shale/extractant continuous mixing part 100 is supplied to the organic oil vapor recovery part 600 having a shape of a condensing jacket using cooling water 620 and then condensed and recovered through a suction pump 610, thus preventing the organic oil vapor generated from the oil shale/extractant continuous mixing part 100 from being discharged to the air.

So as to allow the oil shale sludge maintained at the pressurized state in the kerogen extraction part 500 to be stably conveyed to an intermediate storage tank 800, pressure drop should be step by step conducted. Accordingly, a pressure control buffering tank 750 and first and second pressure control discharging valves 700 and 710 are additionally disposed between the kerogen extraction part 500 and the intermediate storage tank 800.

The supply of the oil shale sludge from the oil shale/extractant continuous mixing part 100 to the kerogen extraction part 500 is conducted by means of the sludge pressuring and supplying pump 400, and the discharging of the quantity of oil shale sludge fed from the kerogen extraction part 500 is conducted by means of the degree of opening and closing of the first pressure control discharging valve 700. So as to control the reaction time and the fixed quantity discharging in the kerogen extraction part 500, the feeding speed of the sludge pressuring and supplying pump 400 and the discharge quantity control through the degree of opening and closing of the first pressure control discharging valve 700 are achieved in an automatic control way using a proportional automatic controller 990. Accordingly, the continuous feeding and discharging of the pressurized sludge are gently obtained, and the residence time, that is, the reaction time in the kerogen extraction part 500 is easily controlled.

So as to stably convey the pressurized oil shale sludge discharged from the kerogen extraction part 500 to the intermediate storage tank 800, two or more (multiple) pressure control valves are mounted, and accordingly, pressure drop is step by step conducted, thus allowing the operation of the kerogen extraction part 500 to be easy. In more detail, the pressure control buffering tank 750 and the first and second pressure control discharging valves 700 and 710 are additionally disposed between the kerogen extraction part 500 and the intermediate storage tank 800. When the oil shale sludge heated in the kerogen extraction part 500 being at the pressurized state is discharged to the intermediate storage tank 800 through the first and second pressure control discharging valves 700 and 710, the extractant being at the state of liquid phase-low boiling point oil at the pressurized state is evaporated, so that an extractant recovery tank 900 is additionally disposed to separate and recover the low boiling point oil.

Reference numerals 150 and 550 not explained yet indicate discharging valves, and 630 indicates condensed vapor. Further, reference numerals 810 and 820 indicate a discharging valve and an oil vapor outlet of the intermediate storage tank 800, and 910 and 920 indicate an exhaust port and low boiling point oil.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

According to the present invention, there is provided the apparatus and method for pressurized heating, and continuously supplying and discharging the oil shale sludge that is configured to improve the semi-continuous operation in which the plurality of unit extractors each has a kerogen extraction part and an intermediate storage tank and the kerogen extraction part and the intermediate storage tank are alternately operated, thus achieving a continuous operation. Further, the sludge pressuring and supplying pump 400 is located between the oil shale/extractant continuous mixing part 100 and the kerogen extraction part 500, and the multi-stage pressure control discharging valves 700 and 710 are disposed on the outlet of the kerogen extraction part 500, thus allowing the oil shale sludge being at the pressurized state to be continuously supplied to the kerogen extraction part 500 and further allowing the kerogen extraction part 500 to be continuously operated. In addition, the oil shale and the extractant/light oil introduced into the oil shale/extractant continuous mixing part 100 are maintained in the pre-heated state, thus allowing the energy load of the kerogen extraction part 500 caused by the heating of the heat medium of the oil shale/extractant continuous mixing part 100 to be divided and reduced by the oil shale/extractant continuous mixing part, decreasing the reactor size (that is, the residence time), and achieving easy scale-up and high industrial applicability.

The invention claimed is:

1. An apparatus for pressurized heating and continuously supplying and discharging oil shale sludge to and from a kerogen extraction part, the apparatus comprising:

an oil shale supplier, wherein the oil shale supplier supplies oil shale stored in an oil shale storage tank, from which water is removed, to an oil shale/extractant continuous mixing part, through a supplying pipe connector;

an extractant/light oil supplying pump for supplying the extractant or light oil stored in an extractant storage tank to the oil shale/extractant continuous mixing part;

a sludge pressurizing and supplying pump for conveying the oil shale sludge made by agitating and mixing the oil shale and the extractant/light oil in the oil shale/extractant continuous mixing part to the kerogen extraction part;

an organic oil vapor recovery member, wherein the organic oil vapor recovery member condenses and recovers organic oil vapor generated during the heating of the oil shale/extractant continuous mixing part; and a first pressure control discharging valve for discharging oil shale extraction residual matters remaining after the extraction of the oil shale sludge in the kerogen extraction part, wherein the oil shale/extractant continuous mixing part and the kerogen extraction part have heat medium heating coils disposed on the interiors thereof.

2. The apparatus according to claim 1, wherein the oil shale/extractant continuous mixing part and the kerogen extraction part have agitators mounted in the interiors thereof to pass heat media therethrough.

3. The apparatus according to claim 1, wherein the oil shale/extractant continuous mixing part and the kerogen extraction part have support plates mounted on the interiors thereof so as to support the heating coils, the supports plates serving as baffles adapted to increase mixing and heating effects.

4. The apparatus according to claim 1, wherein the organic oil vapor generated during the heating of the oil shale/extractant continuous mixing part is sucked by the organic oil vapor recovery member by means of a suction pump and recovered to the form of condensed vapor by means of cooling water flowing along the external surface of the organic oil vapor recovery member.

5. The apparatus according to claim 1, wherein the first pressure control discharging valve for discharging oil shale extraction residual matters remaining after the extraction of the oil shale sludge in the kerogen extraction part is connected sequentially to a buffering tank, a second pressure control discharging valve and an intermediate storage tank.

* * * * *